US009182724B2

(12) United States Patent
Sasaki

(10) Patent No.: US 9,182,724 B2
(45) Date of Patent: Nov. 10, 2015

(54) CARRIER DEVICE AND IMAGE-FORMING DEVICE

(75) Inventor: Toshinori Sasaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 967 days.

(21) Appl. No.: 12/553,756

(22) Filed: Sep. 3, 2009

(65) Prior Publication Data

US 2010/0189484 A1 Jul. 29, 2010

(30) Foreign Application Priority Data

Jan. 26, 2009 (JP) ..... 2009-014368

(51) Int. Cl.
*G03G 15/00* (2006.01)
*B65H 29/24* (2006.01)

(52) U.S. Cl.
CPC ..... *G03G 15/6573* (2013.01); *B65H 29/242* (2013.01); *B65H 2404/27* (2013.01); *B65H 2801/06* (2013.01); *G03G 2215/00421* (2013.01); *G03G 2215/00683* (2013.01)

(58) Field of Classification Search
CPC ..... B65H 29/242; B65H 2404/27; B65H 2404/281; B65H 2404/271; B65H 2401/141; G03G 15/6573
USPC ..... 399/388, 400, 397; 198/689.1, 198/813–816, 846, 847
See application file for complete search history.

(56) References Cited

U.S. PATENT DOCUMENTS

| | | | | |
|---|---|---|---|---|
| 4,903,074 | A * | 2/1990 | Lama et al. | 355/76 |
| 5,017,969 | A * | 5/1991 | Mitomi et al. | 399/299 |
| 5,428,435 | A * | 6/1995 | Yasuda et al. | 430/123.55 |
| 5,573,619 | A * | 11/1996 | Benedict et al. | 156/137 |
| 5,700,356 | A * | 12/1997 | Lefkowitz | 162/358.1 |
| 6,434,344 | B1 * | 8/2002 | Yoshida et al. | 399/44 |
| 2004/0245711 | A1 * | 12/2004 | Domoto et al. | 271/197 |
| 2004/0263560 | A1 | 12/2004 | Nakashima | |
| 2006/0079627 | A1 * | 4/2006 | Noguchi et al. | 524/496 |
| 2006/0139431 | A1 | 6/2006 | Nakashima | |
| 2007/0048013 | A1 * | 3/2007 | Tokutake et al. | 399/159 |
| 2007/0071529 | A1 * | 3/2007 | Lee et al. | 399/400 |

FOREIGN PATENT DOCUMENTS

| | | | |
|---|---|---|---|
| JP | 54144664 | A | 11/1979 |
| JP | 62244836 | A | 10/1987 |
| JP | 8137294 | A | 5/1996 |
| JP | 09-150987 | | 6/1997 |
| JP | 200522177 | A | 1/2005 |
| WO | 2009001808 | A1 | 12/2008 |

* cited by examiner

*Primary Examiner* — Jennifer Simmons
(74) *Attorney, Agent, or Firm* — Morgan, Lewis & Bockius LLP

(57) ABSTRACT

A carrier device includes: a circular belt made of a breathable nonwoven fabric; plural rolls on which the belt is hung so that the rolls contact a surface of an inner circumference of the belt, that causes the belt to rotate; and a decompression unit that reduces pressure in an area surrounded by the belt.

20 Claims, 4 Drawing Sheets

CARRIER DEVICE AND IMAGE-FORMING DEVICE

CROSS-REFERENCE TO RELATED APPLICATIONS

This application is based on and claims priority under 35 USC 119 from Japanese Patent Application No. 2009-014368 filed on Jan. 26, 2009.

BACKGROUND

Technical Field

The present invention relates to a carrier device and an image-forming device.

SUMMARY

An aspect of the present invention provides a carrier device including: a circular belt made of a breathable nonwoven fabric; plural rolls on which the belt is hung so that the rolls contact a surface of an inner circumference of the belt, that causes the belt to rotate; and a decompression unit that reduces pressure in an area surrounded by the belt.

BRIEF DESCRIPTION OF THE DRAWINGS

Exemplary embodiments of the present invention will now be described in detail below with reference to the following figures, wherein.

DETAILED DESCRIPTION

Exemplary Embodiment

Figure 1:
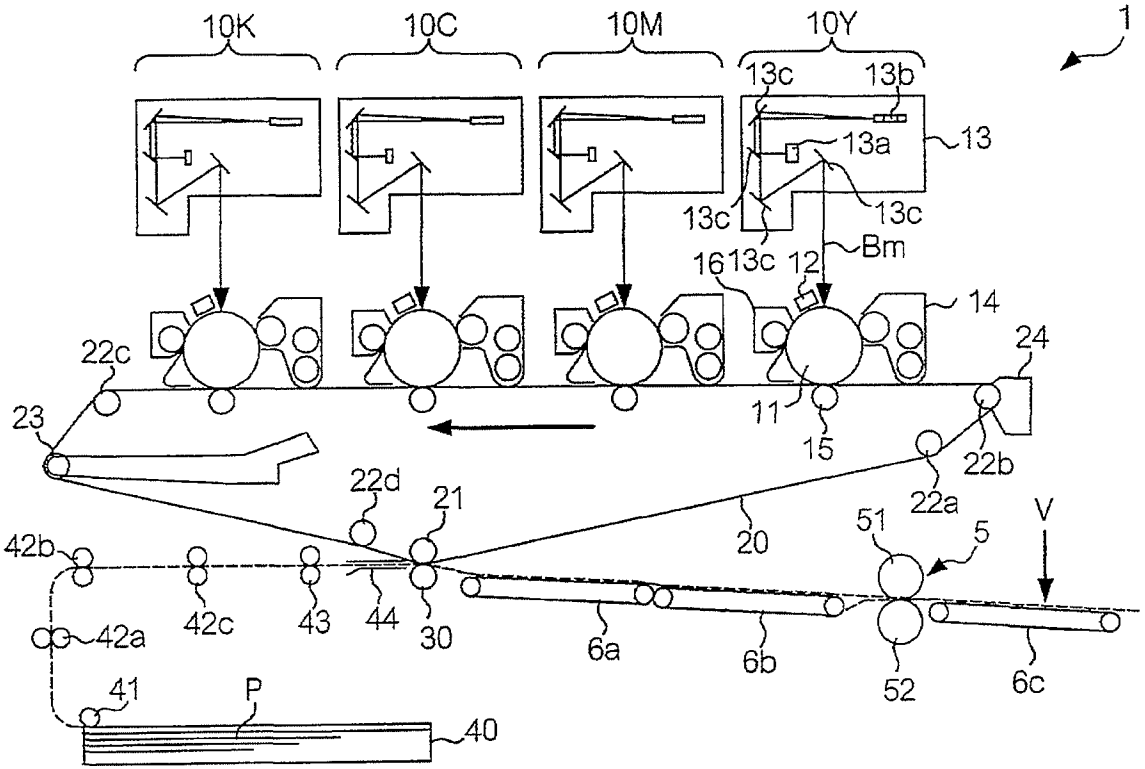
FIG. 1 is a view showing a frame format of image-forming device 1 according to an exemplary embodiment of the present invention.

FIG. 1 is a view showing a frame format of image-forming device 1, which is an example of a device according to an exemplary embodiment of the present invention.

Image-forming device 1 is an electro-photographic device that receives image data from a computer such as a personal computer, forms an image represented by the image data on a recording medium, and outputs the recording medium. Image-forming device 1 on receipt of image data representing a color image, generates images in each of the colors yellow (Y), magenta (M), cyan (C), or black (K) on the basis of the received image data. Subsequently, image-forming device 1 forms toner images in each of the above colors using a toner (developer) of each color, transfers a color image composed of the toner images of each color on a recording medium, and outputs the recording medium.

It is to be noted that in the drawings and the description that follows, components of image-forming device 1 relating to formation of a yellow image is followed by letter Y, components relating to formation of a magenta image is followed by letter M, components relating to formation of a cyan image is followed by letter C, and components relating to formation of a black image is followed by letter K. If it is unnecessary to specify otherwise, a trailing letter is omitted.

Configuration of Exemplary Embodiment

Image-forming device 1 includes image-forming unit 10K that forms a black toner image, image-forming unit 10Y that forms a yellow toner image, image-forming unit 10M that forms a magenta toner image, image-forming unit 10C that forms a cyan toner image, and intermediate transfer belt 20 to which toner images formed by image-forming units 10 are transferred as a first transfer process. Image-forming device 1 forms a color image by transferring the toner images transferred to intermediate transfer belt 20 to recording sheet P as a second transfer process.

Image-forming units 10Y, 10M, 10C, and 10K are provided along a rotational direction of intermediate transfer belt 20 in the order of image-forming unit 10Y, image-forming unit 10M, image-forming unit 10C, and image-forming unit 10K. Image-forming units 10 generate an image on the basis of image data, form a toner image on the basis of the generated image, and transfer the toner image to intermediate transfer belt 20 as a first transfer process.

Image-forming units 10 specifically include photosensitive drum 11 on which an electrostatic latent image is formed, charging device 12 that charges photosensitive drum 11, exposure device 13 that exposes photosensitive drum 11 to laser light Bm to form an electrostatic latent image on photosensitive drum 11, developing device 14 that develops an electrostatic image formed on photosensitive drum 11 to form a toner image, first transfer roll 15 that transfers a toner image formed on photosensitive drum 11 to intermediate transfer belt 20, and photoreceptor cleaner 16 that cleans a surface of photosensitive drum 11 after a toner image is transferred from the drum.

Photosensitive drum 11 is a cylindrical drum made of a thin metal sheet on which an organic photosensitive layer is formed. On photosensitive drum 11 an electrostatic latent image is formed. Charging device 12 includes scorotron charger, which charges photosensitive drum 11. Exposure device 13 includes semiconductor laser device 13*a* that outputs laser light Bm, which is modulated according to an image generated based on image data, and polygon mirror 13*b* that rotates to reflect laser light Bm along an axial direction of photosensitive drum 11. Laser light Bm is reflected by plural mirrors 13*c* and travels in a predetermined path, and when reaching photosensitive drum 11, laser light Bm forms an electrostatic latent image on photosensitive drum 11.

Developing device 14 is filled with a mixture of toner and carrier which is a collection of magnetic particles. Developing device 14 of image-forming unit 10Y is filled with a yellow toner, developing device 14 of image-forming unit 10M is filled with a magenta toner, developing device 14 of image-forming unit 10C is filled with a cyan toner, and developing device 14 of image-forming 10K is filled with a black toner. Developing device 14 develops an electrostatic latent image formed on photosensitive drum 11, using a toner to form a toner image.

First transfer roll 15 is provided at a position in which photosensitive drum 11 and intermediate transfer belt 20 face each other, so that first transfer roll 15 opposes photosensitive drum 11 via intermediate transfer belt 20. If a predetermined bias current is applied to first transfer roll 15, an electric field is formed between photosensitive drum 11 and first transfer roll 15, and a toner image formed on photosensitive drum 11, which is electrically-charged, is transferred to intermediate transfer belt 20 by coulomb force. First transfer roll 15 is a metallic shaft covered with a conductive foamed rubber.

Intermediate transfer belt 20 is configured as a circular belt, and hung by belt carrier rolls 21, 22*a* to 22*d*, and 23. Intermediate transfer belt 20 moves in the direction of an arrow shown in FIG. 1, and while intermediate transfer belt 20 is moving, toner images formed in image-forming units 10Y, 10M, 10C, and 10K are transferred to intermediate transfer belt 20 as a first transfer process.

At a position opposing belt carrier roll 21 via intermediate transfer belt 20, second transfer roll 30 is provided. Recording sheet P is guided to a contact face of second transfer roll 30 and intermediate transfer belt 20, and a toner image transferred to intermediate transfer belt 20 is transferred to recording sheet P as a second transfer process. At a position opposing belt carrier roll 22*b* via intermediate transfer belt 20, cleaner 24 is provided. Cleaner 24 removes toner remaining on intermediate transfer belt 20 after a second transfer is completed.

Now, a configuration for fixing a toner image formed on recording sheet P, on the medium and a configuration for carrying recording sheet P will be described.

Image-forming device 1 includes fixing device 5 including heating roll 51 with an internal heat source, and pressure roll 52, which is to be pressed against heating roll 51. Fixing device 5 performs a fixing operation to a toner image. After a toner image is transferred to recording sheet P, the medium is guided to a contact face of heating roll 51 heated by a heat source and pressure roll 52. Subsequently, if a fixing operation is performed by heating roll 51 and pressure roll 52 to apply heat and pressure to the toner image, the toner image dissolves, and if the dissolved toner image is cooled, the toner image is fixed on recording sheet P.

Image-forming device 1 also includes, as a configuration for carrying recording sheet P, recording sheet storage unit 40 that stores plural recording sheets, pickup roll 41 that retrieves each of the recording sheets P from recording sheet storage unit 40, pairs of carrier rolls 42*a* to 42*c* that sequentially carry retrieved recording sheet P, a pair of rolls 43 that starts carrying at a predetermined time, guide member 44 that guides recording sheet P along a carrier path, sheet carrier devices 6*a* and 6*b* that carry recording sheet P onto which a toner image has been transferred to fixing device 5, sheet carrier device 6*c* that carries recording sheet P subjected to a fixing operation to discharge the sheet to the outside of image-forming device 1.

Figure 2:
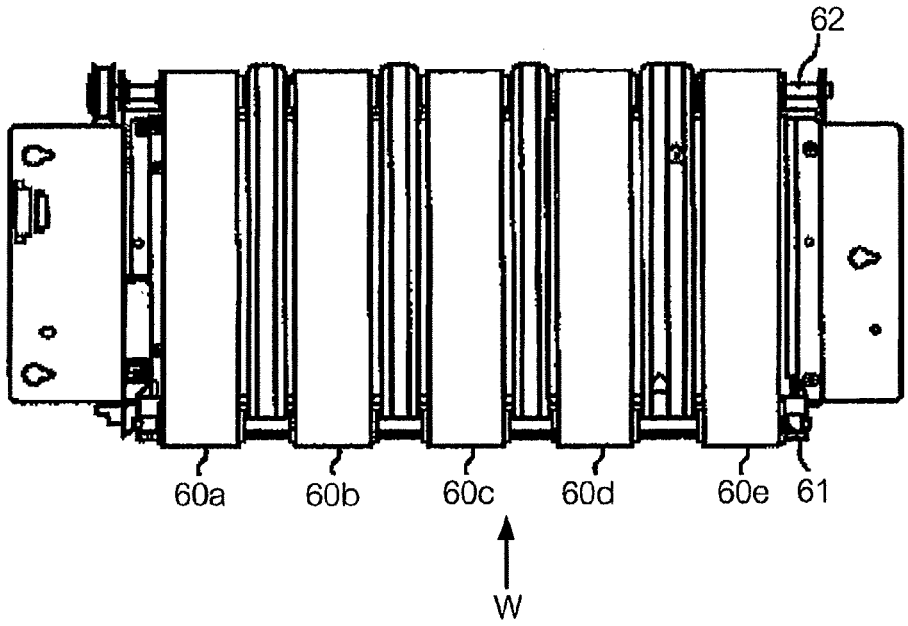
FIG. 2 is a plain view of sheet carrier device 6*c;*
Figure 3:
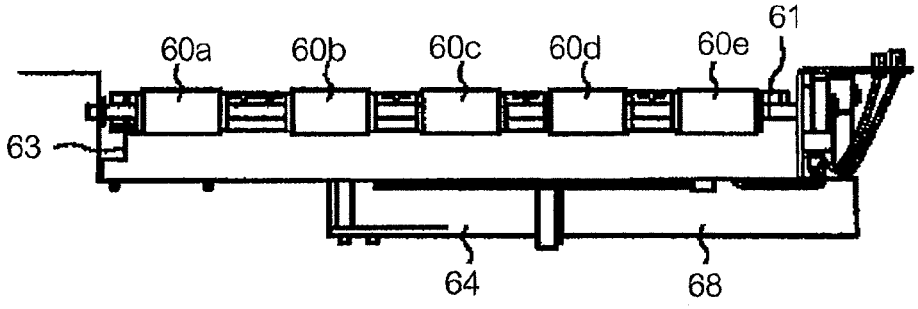
FIG. 3 is a side view of sheet carrier device 6*c;*
Figure 4:
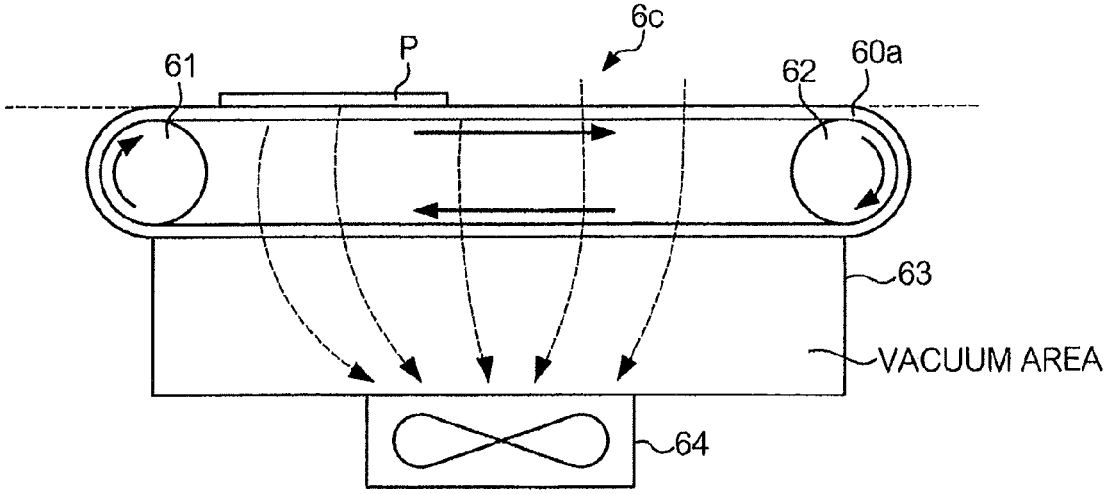
FIG. 4 is a view showing a frame format of a configuration of sheet carrier device 6*c;*

FIG. 2 is a diagram showing sheet carrier device 6*c* as seen in the direction of arrow V of FIG. 1. FIG. 3 is a diagram showing sheet carrier device 6*c* as seen in the direction of arrow W of FIG. 2. FIG. 4 is a view showing a frame format of a configuration of sheet carrier device 6*c*.

Sheet carrier device 6*c* includes breathable carrier belts 60*a* to 60*e* that carry recording sheet P, two rolls 61 and 62 that apply tension to carrier belts 60*a* to 60*e* hung on the rolls and cause the belts to rotate, housing 63 that forms a vacuum area for reducing pressure in an area surrounded by a surface of the inner circumference of carrier belts 60*a* to 60*e*, fan unit 64 including a fan, that reduces pressure in the vacuum area, and duct 68 leading to fan unit 64. In sheet carrier device 6*c*, recording sheet P is carried by carrier belts 60*a* to 60*e* while being sucked by the belts.

Carrier belts 60*a* to 60*e* are circular belts, or substantially circular belts, made of a strip of polyurethane nonwoven fabric, in which air is able to pass through the fibers from the front side to the back side of the belt. The thickness of carrier belts 60*a* to 60*e* is no less than 0.1 [mm], nor more than 0.4 [mm], or no less than approximately 0.1 [mm], nor more than approximately 0.4 [mm]. The weight per unit area of carrier belts 60*a* to 60*e* is no less than 30 [g/m$^2$], nor more than 100 [g/m$^2$], or no less than approximately 30 [g/m$^2$], nor more than approximately 100 [g/m$^2$]. The coefficient of static surface friction of carrier belts 60*a* to 60*e* is no less than 0.1, nor more than 0.8, or no less than approximately 0.1, nor more than approximately 0.8. Carrier belts 60*a* to 60*e* are hung on rolls 61 and 62 at a hanging rate of no less than 3 percent, nor more than 10 percent, or no less than approximately 3 percent, nor more than approximately 10 percent. A hanging rate is expressed in the following formula, given that a peripheral length of an intermediate transfer belt hung on rolls 61 and 62 and tensioned is C1, and a peripheral length of an intermediate transfer belt not hung on rolls 61 and 62 and not tensioned is C2

$$\text{Hanging Rate (percent)}=(C1-C2)/C2\cdot 100$$

The inventor of the present invention has conducted experiments on carrier belts 60*a* to 60*e* to consider property values of carrier belts 60*a* to 60*e*.

Figure 5:
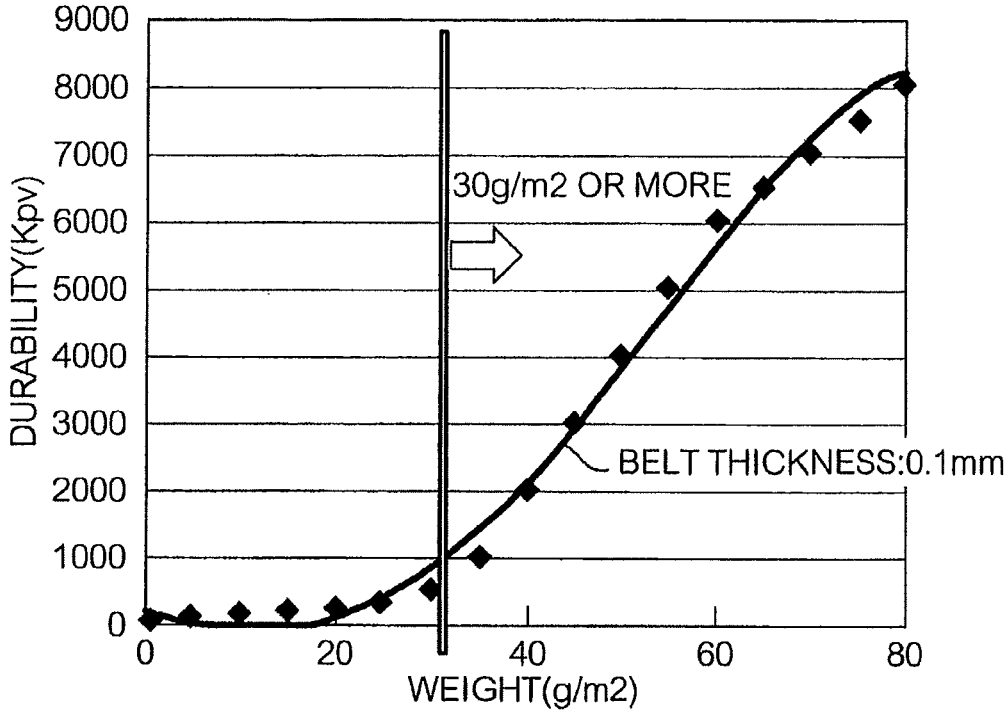
FIG. 5 is a diagram showing results of an experiment on a carrier belt.

FIG. 5 is a graph showing measured values of durability of carrier belts 60*a* to 60*e*, given that the thickness of carrier belts 60*a* to 60*e* is 0.1 [mm], and the weight of carrier belts 60*a* to 60*e* is changed. The unit of durability [kpv] (kiro-print-volume) shown in the vertical axis of FIG. 5 indicates the number of recording sheets P that have been carried while carrier belts 60*a* to 60*e* are not damaged. For example, 1000 [kpv] indicates that a million recording sheets P have been carried. Damage to carrier belts 60*a* to 60*e* has been visually confirmed, and points shown in FIG. 5 indicate the number of recording sheets P calculated when damage to carrier belts 60*a* to 60*e* has been confirmed.

As shown in FIG. 5, if the thickness of carrier belts 60*a* to 60*e* is set to 0.1 [mm], and the weight of the belts is less than 30 [g/m$^2$], the value of durability is less than 1000 [kpv]. In this case, frequency of replacing carrier belts 60*a* to 60*e* increase. Accordingly, in the present exemplary embodiment, the weight of carrier belts 60*a* to 60*e* is set to 30 [g/m$^2$].

Figure 6:
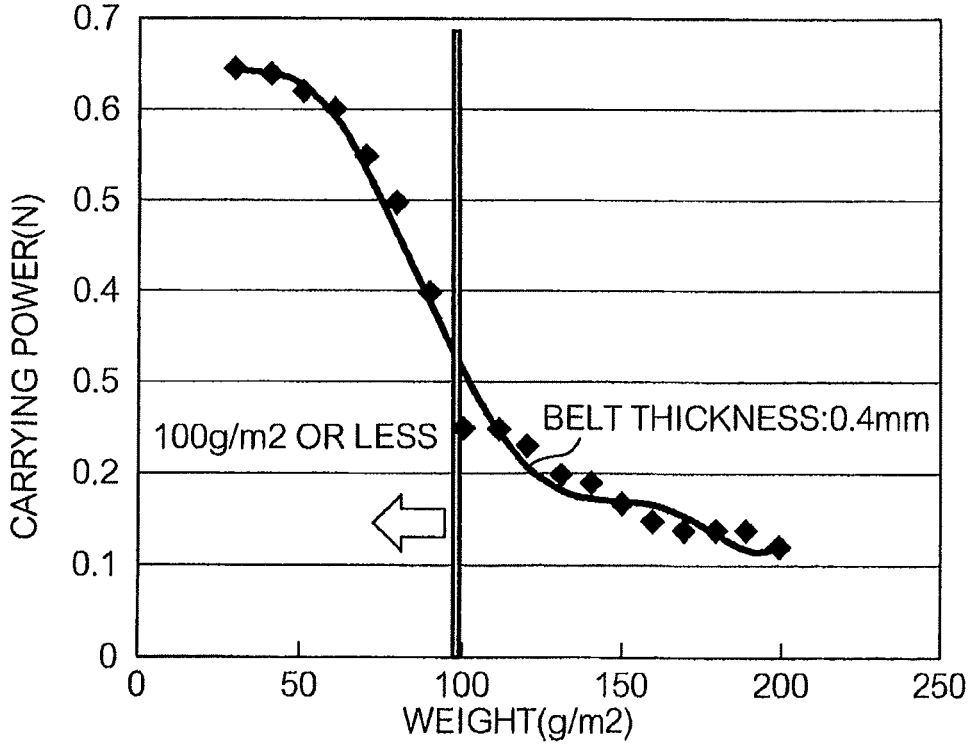
FIG. 6 is a diagram showing results of an experiment on a carrier belt.

Now, FIG. 6 is a graph showing measured values of carrying power of carrier belts 60*a* to 60*e*, given that the thickness of carrier belts 60*a* to 60*e* is 0.1 [mm], and the weight of carrier belts 60*a* to 60*e* is changed. A value of carrying power indicates a value of power required to pull apart recording sheet P from carrier belts 60*a* to 60*e*, sucked by carrier belts 60*a* to 60*e* at a predetermined suction power.

As the weight of carrier belts 60*a* to 60*e* increases, the fiber density per unit area increases. Namely, breathability of carrier belts 60*a* to 60*e* decreases. As shown in FIG. 6, if the thickness of carrier belts 60*a* to 60*e* is set to 0.4 [mm], and the weight of the belts is more than 100 [g/m$^2$], a value of breathability decreases with an increase in the weight of carrier belts 60*a* to 60*e*. In this range, power necessary for sucking recording sheet P is not secured. Accordingly, in the present exemplary embodiment, the weight of carrier belts 60*a* to 60*e* is set to a value less than or equal to 100 [g/m$^2$].

Figure 7:
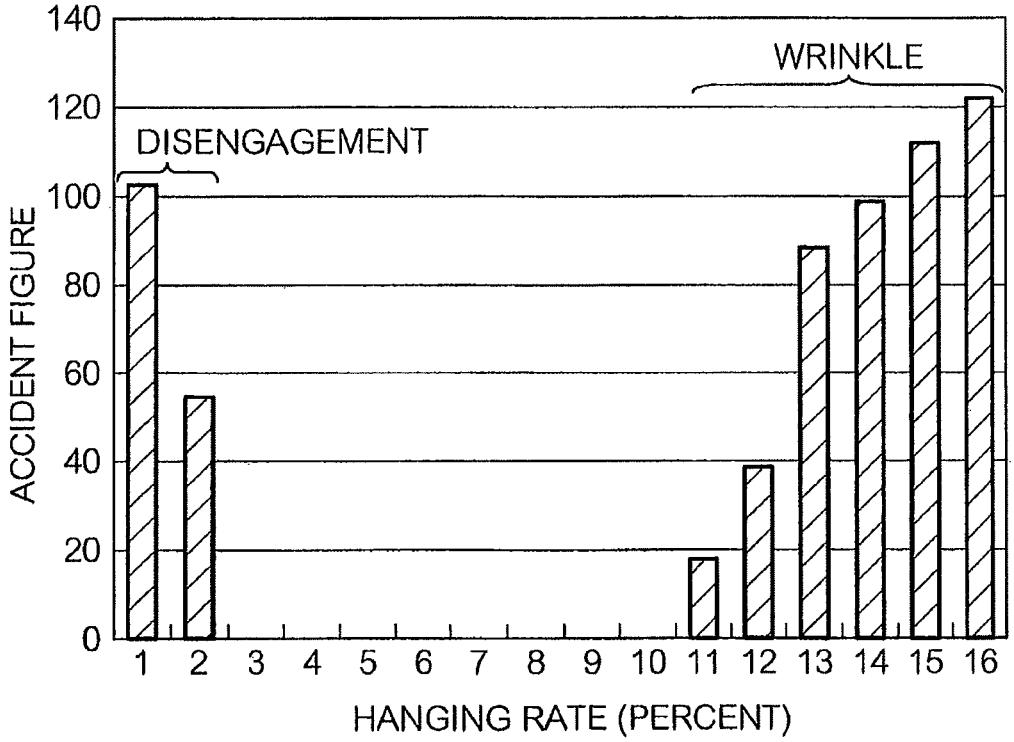
FIG. 7 is a diagram showing results of an experiment on a carrier belt.
Figure 8:
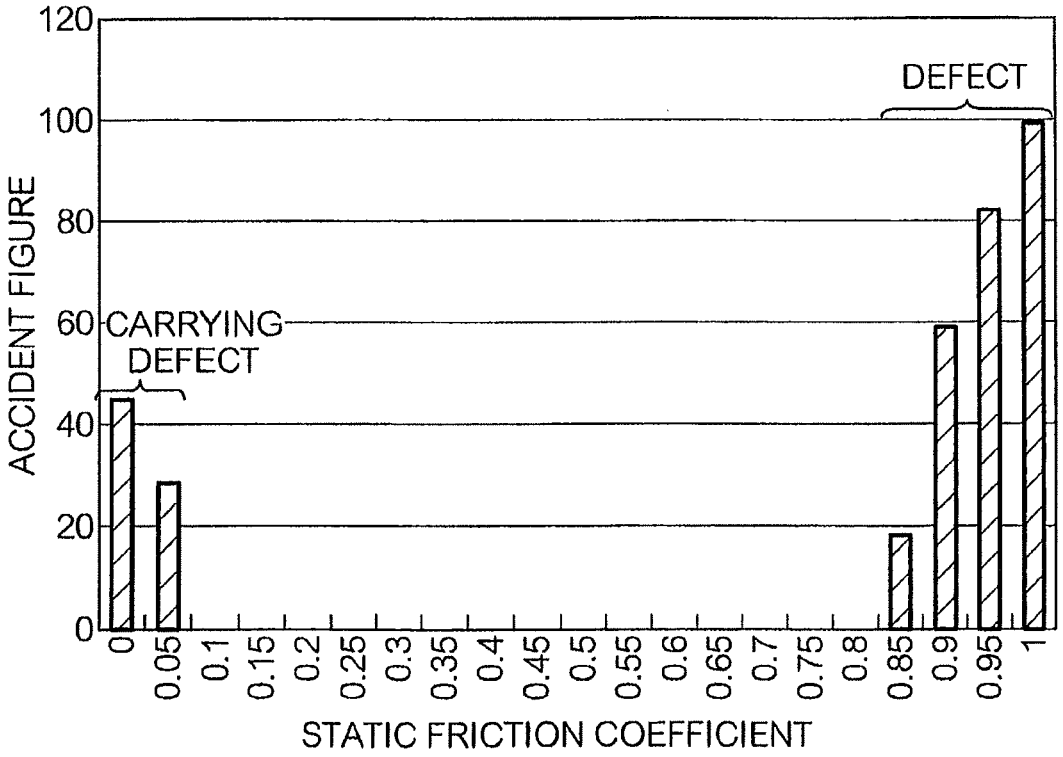
FIG. 8 is a diagram showing results of an experiment on a carrier belt.

Now, FIG. 7 is a graph showing the number of accidents confirmed when the hanging rate of carrier belts 60*a* to 60*e* is changed. FIG. 8 is a graph showing the number of accidents confirmed when the friction coefficient of carrier belts 60*a* to 60*e* is changed. To consider a hanging rate and a static friction coefficient, sheet carrier device 6*c* has been caused to operate for a predetermined time, and accidents have been visually confirmed.

As shown in FIG. 7, if a hanging rate of carrier belts 60*a* to 60*e* falls below 3 percent, an accident occurs, in that, carrier belts 60*a* to 60*e* disengage from rolls 61 and 62. On the other hand, if a hanging rate of carrier belts 60*a* to 60*e* exceeds 10 percent, an accident occurs, in that, carrier belts 60*a* to 60*e* get wrinkled. Accordingly, in the present exemplary embodiment, a hanging rate is set to a value of no less than 3 percent, nor more than 10 percent.

Also, as shown in FIG. 8, if a static friction coefficient of carrier belts 60*a* to 60*e* falls below 0.1, sufficient carrying power is not secured after recording sheet P passes fixing device 5. As a result, a defect of carriage is caused. On the other hand, if a static friction coefficient of carrier belts 60*a* to 60*e* exceeds 0.8, and a toner image is formed on both sides of recording sheet P, the toner image is damaged due to friction between a surface of nonwoven carrier belts 60*a* to 60*e* and recording sheet P. Accordingly, in the present exemplary embodiment, a static friction coefficient of carrier belts 60*a* to 60*e* is set to a value of no less than 0.1, nor more than 0.8.

Operation of Exemplary Embodiment

An operation of image-forming device 1 will be described.

On receipt of color image data sent from a computer, image-forming device 1 generates pieces of data representing images of yellow (Y), magenta (M), cyan (C), and black (K) on the basis of the received image data, and provides each image data to corresponding image-forming unit 10.

Exposure device 13 of image-forming unit 10 that receives one of the pieces of image data irradiates laser beam Bm to photosensitive drum 11, thereby forming an electrostatic latent image on photosensitive drum 11. The electrostatic latent image is developed by developing device 14; as a result, a toner image is formed on photosensitive drum 11. Below photosensitive drum 11, intermediate transfer belt 20 rotates in the direction of an arrow shown in FIG. 1. Toner images of yellow, magenta, cyan, and black are transferred to intermediate transfer belt 20 in layers, in that order.

On the other hand, recording sheet P retrieved by pickup roll 41 from recording sheet storage unit 40 is carried to a pair of rolls 43 by pairs of carrier rolls 42*a* to 42*c*. Subsequently, if intermediate transfer belt 20 rotates so that the toner images formed on intermediate transfer belt 20 reach belt carrier roll 21, the pair of rolls 43 carry recording sheet P to a space between belt carrier roll 21 and second transfer roll 30, and the toner images are transferred to recording sheet P by belt carrier roll 21 and second transfer roll 30 as a second transfer process.

After the toner images are transferred, recording sheet P is carried by sheet carrier devices 6*a* and 6*b* to fixing device 5, and the toner images are subject to heat and pressure by heating roll 51 and pressure roll 52 of fixing device 5. After the toner images dissolve due to heat and pressure, recording sheet P is carried to sheet carrier device 6*c*.

In sheet carrier device 6*c*, a fan of fan unit 64 rotates to reduce pressure in a vacuum area. In addition, carrier belts 60*a* to 60*e* are breathable, as described above. Accordingly, as shown by dashed lines of FIG. 4, an air flow arises from the upper side of carrier belts 60*a* to 60*e* to duct 68 via the inner space of carrier belts 60*a* to 60*e*, the lower side of carrier belts 60*a* to 60*e*, a vacuum area, and fan unit 64.

Due to a suction effect generated by the air flow, recording sheet P holding the toner images is sucked and held by carrier belts 60*a* to 60*e*, and carried by carrier belts 60*a* to 60*e* to the outside of image-forming device 1.

[Modifications]

The above exemplary embodiment of the present invention may be modified as described below.

In the above exemplary embodiment where image-forming device 1 forms an image on recording sheet P on the basis of received image data, image-forming device 1 may have a copy function for copying a document. Also, in the above exemplary embodiment where sheet carrier device 6*c* is provided in electro-photographic image-forming device 1, sheet carrier device 6*c* may be provided in an image-forming device that forms an image in other systems such as an ink-jet system, as a unit for carrying recording sheets.

In the above exemplary embodiment where carrier belts 60*a* to 60*e* are made of polyurethane, carrier belts 60*a* to 60*e* may be made of other materials such as polyamide, polyester, polyethylene, polypropylene, or fluorine fiber. If material other than polyurethane is employed, it is necessary to adjust a weight, thickness, hanging rate, and friction coefficient of carrier belts 60*a* to 60*e* depending on the material.

Also, carrier belts 60*a* to 60*e* may be made of a string of fibers, or made of cut fibers of a predetermined length.

In the above exemplary embodiment where sheet carrier device 6*c* has five lines of carrier belts, the number of carrier belts may be more than five, or less than five. A width of a carrier belt may be broader than a width of recording sheet P so that a line of a carrier belt is able to carry recording sheet P.

In the above exemplary embodiment where sheet carrier device 6*c* is provided downstream, in a transport direction of recording sheet P, as compared to fixing device 5, sheet carrier devices 6*a* and 6*b* provided upstream as compared to fixing device 5 may employ the same configuration as that of sheet carrier device 6*c*.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A carrier device comprising:

an endless belt made of only a nonwoven fabric from the front side to the back side so that air is able to pass uniformly through an entire surface of the belt, the surface being configured to allow suction of a recording sheet;

a plurality of rolls on which the belt is hung so that the rolls contact a surface of an inner circumference of the belt, that causes the belt to rotate; and a decompression unit that reduces pressure in an area surrounded by the belt, wherein air is able to pass through fibers of the nonwoven fabric.

2. The carrier device according to claim 1, wherein the nonwoven fabric is made of polyurethane.

3. The carrier device according to claim 2, wherein a weight of the belt is no less than approximately 30 g/m$^2$, nor more than approximately 100 g/m$^2$.

4. The carrier device according to claim 3, wherein a thickness of the belt is no less than approximately 0.1 mm, nor more than approximately 0.4 mm.

5. The carrier device according to claim 3, wherein the belt is hung on the plurality of rolls at a hanging rate of no less than approximately 3 percent, nor more than approximately 10 percent.

6. The carrier device according to claim 3, wherein a static friction coefficient of the belt is no less than approximately 0.1, nor more than approximately 0.8.

7. The carrier device according to claim 2, wherein a thickness of the belt is no less than approximately 0.1 mm, nor more than approximately 0.4 mm.

8. The carrier device according to claim 7, wherein the belt is hung on the plurality of rolls at a hanging rate of no less than approximately 3 percent, nor more than approximately 10 percent.

9. The carrier device according to claim 7, wherein a static friction coefficient of the belt is no less than approximately 0.1, nor more than approximately 0.8.

10. The carrier device according to claim 2, wherein the belt is hung on the plurality of rolls at a hanging rate of no less than approximately 3 percent, nor more than approximately 10 percent.

11. The carrier device according to claim 10, wherein a static friction coefficient of the belt is no less than approximately 0.1, nor more than approximately 0.8.

12. The carrier device according to claim 2, wherein a static friction coefficient of the belt is no less than approximately 0.1, nor more than approximately 0.8.

13. The carrier device according to claim 12, wherein the static friction coefficient of the belt is a coefficient of friction between the belt and a recording sheet.

14. An image-forming device comprising:

the carrier device according to claim 1;

an image-forming unit that forms an image on a surface of the recording sheet;

a carrier unit that carries the recording sheet, on the surface of which the image has been formed by the image-forming unit, to a surface of the belt of the carrier device; and a fixing unit that fixes the image that has been formed by the image-forming unit, on the surface of the recording sheet, wherein;

the carrier device is arranged downstream as compared with the fixing unit in a transport direction of the recording sheet; and the recording sheet that has been heated by the fixing unit is carried by the carrier device.

15. An image-forming device comprising:

the carrier device according to claim 2;

an image-forming unit that forms an image on a surface of the recording sheet;

a carrier unit that carries the recording sheet, on the surface of which the image has been formed by the image-forming unit, to a surface of the belt of the carrier device; and a fixing unit that fixes the image that has been formed by the image-forming unit, on the surface of the recording sheet, wherein;

the carrier device is arranged downstream as compared with the fixing unit in a transport direction of the recording sheet; and the recording sheet that has been heated by the fixing unit is carried by the carrier device.

16. An image-forming device comprising:

the carrier device according to claim 3;

an image-forming unit that forms an image on a surface of the recording sheet;

a carrier unit that carries the recording sheet, on the surface of which the image has been formed by the image-forming unit, to a surface of the belt of the carrier device; and a fixing unit that fixes the image that has been formed by the image-forming unit, on the surface of the recording sheet, wherein;

the carrier device is arranged downstream as compared with the fixing unit in a transport direction of the recording sheet; and the recording sheet that has been heated by the fixing unit is carried by the carrier device.

17. An image-forming device comprising:

the carrier device according to claim 7;

an image-forming unit that forms an image on a surface of the recording sheet;

a carrier unit that carries the recording sheet, on the surface of which the image has been formed by the image-forming unit, to a surface of the belt of the carrier device; and a fixing unit that fixes the image that has been formed by the image-forming unit, on the surface of the recording sheet, wherein;

the carrier device is arranged downstream as compared with the fixing unit in a transport direction of the recording sheet; and the recording sheet that has been heated by the fixing unit is carried by the carrier device.

18. An image-forming device comprising:

the carrier device according to claim 10;

an image-forming unit that forms an image on a surface of the recording sheet;

a carrier unit that carries the recording sheet, on the surface of which the image has been formed by the image-forming unit, to a surface of the belt of the carrier device; and a fixing unit that fixes the image that has been formed by the image-forming unit, on the surface of the recording sheet, wherein;

the carrier device is arranged downstream as compared with the fixing unit in a transport direction of the recording sheet; and the recording sheet that has been heated by the fixing unit is carried by the carrier device.

19. An image-forming device comprising:

the carrier device according to claim 12;

an image-forming unit that forms an image on a surface of the recording sheet;

a carrier unit that carries the recording sheet, on the surface of which the image has been formed by the image-forming unit, to a surface of the belt of the carrier device; and a fixing unit that fixes the image that has been formed by the image-forming unit, on the surface of the recording sheet, wherein;

the carrier device is arranged downstream as compared with the fixing unit in a transport direction of the recording sheet; and the recording sheet that has been heated by the fixing unit is carried by the carrier device.

20. A carrier device comprising:

an endless belt made of only a nonwoven fabric from the front side to the back side so that air is able to pass uniformly through an entire surface of the belts, the surface being configured to allow suction of a recording sheet;

a plurality of support means on which the belt is hung so that the support means contact a surface of an inner circumference of the belt, for causing the belt to rotate; and a decompression means for reducing pressure in an area surrounded by the belt, wherein air is able to pass through fibers of the nonwoven fabric.

* * * * *